US006823894B1

(12) United States Patent
Koller et al.

(10) Patent No.: US 6,823,894 B1
(45) Date of Patent: Nov. 30, 2004

(54) DOWNSPOUT LATERAL OUTLET WATER SPLAY APPARATUS

(76) Inventors: James A. Koller, 260 Kiesner Dr., Chilton, WI (US) 53014; Lee A. Roehrig, 293 Kiesner Dr., Chilton, WI (US) 53014

( * ) Notice: Subject to any disclaimer, the term of this patent is extended or adjusted under 35 U.S.C. 154(b) by 28 days.

(21) Appl. No.: 10/443,720

(22) Filed: May 23, 2003

(51) Int. Cl.[7] ..... E03B 3/00; E04D 13/00

(52) U.S. Cl. ..... 137/615; 52/16; 138/37; 239/208

(58) Field of Search ..... 137/615, 561; 239/75, 208; 52/16; 138/37

(56) References Cited

U.S. PATENT DOCUMENTS

| | | | | |
|---|---|---|---|---|
| 3,904,121 A | * | 9/1975 | Geagan | 239/208 |
| 4,620,817 A | | 11/1986 | Cushing | 405/43 |
| 5,358,007 A | * | 10/1994 | Carlberg | 137/615 |
| 5,533,303 A | | 7/1996 | Harvey | 52/16 |
| 5,862,632 A | | 1/1999 | Zima | 52/11 |
| 6,012,682 A | | 1/2000 | Tredennick | 248/48.1 |

* cited by examiner

*Primary Examiner*—Harry B. Tanner
(74) *Attorney, Agent, or Firm*—Robert T. Johnson

(57) ABSTRACT

Splay nozzle apparatus attached to the outlet end of a lateral spout, to splay the water laterally from the outlet to overcome the problem of erosion of the ground as had on direct flow from a lateral spout onto the ground.

4 Claims, 6 Drawing Sheets

DOWNSPOUT LATERAL OUTLET WATER SPLAY APPARATUS

FIELD OF THE INVENTION

Figure 1:
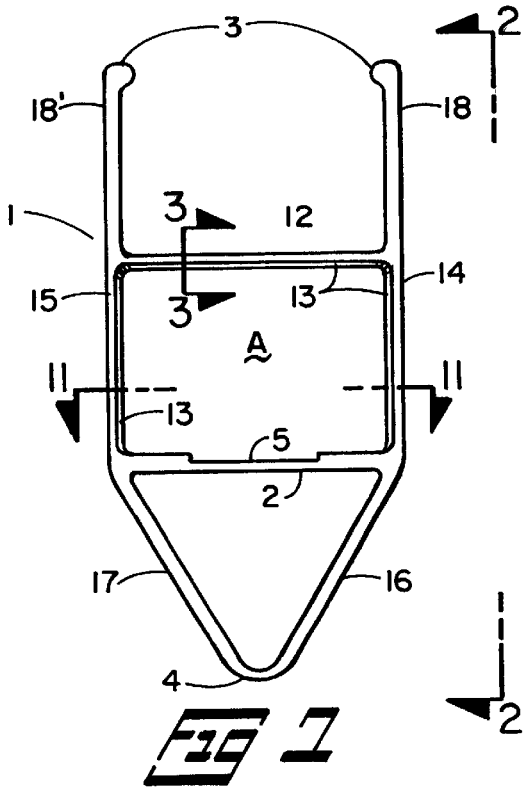

Eaves down spouts from buildings often are connected to a lateral spout, the end of which rests on the ground, and on venting water from the eaves, tends to erode the ground at the eaves lateral discharge end.

BRIEF SUMMARY OF THE INVENTION

This present invention includes a splay nozzle apparatus attached to the end of lateral spout outlet to reduce the velocity of the water effluent from the lateral spout, and change the effluent water direction by 90° to flow through the splay nozzle, which is self cleaning of debris, to disperse the water effluent laterally, to be perpendicular to the effluent flow from the lateral spout, rather than the straight discharge attained by water flowing straight from the lateral spout discharge end, which straight flow erodes the soil.

OBJECTS OF THE INVENTION

An object of this invention is to disclose a water splay apparatus, a splay nozzle, and a splay nozzle holder, attached to the discharge end of lateral spout, and clamp arms on the splay nozzle holder.

Another object of the invention is to disclose assembly of splay nozzle and splay nozzle holder, including clamp arms on the splay nozzle holder on the discharge end of the lateral down spout, and pivoting the down spout lateral discharge end upward on a hinge, at the inlet of the lateral down spout to attach to the connecting vertical down spout, by friction fit of the clamp arms of the splay nozzle holder, Another object of this invention is to disclose a method of diverting rainwater at a 90° or perpendicular to the outlet of a down spout lateral by a splay nozzle and splay nozzle holder attached to lateral down spout effluent end, and clamp arms of the splay nozzle holder attached to lateral down spout attach by friction fit to the vertical down spout attached by a hinge joint to inlet end of the lateral spout in the absence of rainwater.

Another object of this invention is to disclose a ground rest or foot on the splay nozzle holder of the splay nozzle.

BRIEF DESCRIPTION OF DRAWING FIGURES

| FIG. NO. | DESCRIPTION |
|---|---|
| 1 | Front elevation view of water splay nozzle holder. |
| 2 | Side elevation view of water splay nozzle holder. |
| 3 | Cross section view of top span of aperture. |
| 4 | Perspective view of water splay nozzle holder. |
| 5 | Plan view of water splay nozzle. |
| 6 | Side elevation view of water splay nozzle. |
| 7 | Front elevation view of water splay nozzle. |
| 8 | Perspective view of water splay nozzle. |
| 9 | Exploded perspective view of alignment of components of water splay apparatus. |

-continued

| FIG. NO. | DESCRIPTION |
|---|---|
| 10 | Perspective view of assembled components of water splay apparatus. |
| 11 | Plan view of vertical side walls of aperture. |
| 12 | Perspective view of assembled components of water splay apparatus and down spout lateral fitting in aperture of water splay nozzle holder. |
| 13 | Exploded side elevation view of water splay nozzle holder, nozzle and down spout lateral spout. |
| 14 | Side elevation view of assembly of water splay nozzle holder, nozzle and down spout lateral spout. |
| 15 | Splay nozzle, and splay nozzle holder assembly mounted on lateral spout held in upright position. |
| 16 | Splay nozzle, and splay nozzle holder assembly mounted on lateral spout in transition to horizontal position. |
| 17 | Splay nozzle, and splay nozzle holder assembly mounted on lateral spout, and the lateral spout in horizontal or drain position. |

DESCRIPTIONS OF DRAWING LEGENDS

| LEGEND NO. | DESCRIPTION. |
|---|---|
| 1 | Splay nozzle holder. |
| 2 | Lower cross piece of splay nozzle holder of lateral down spout aperture. |
| 3 | Ridges on down spout clamp. |
| 4 | Ground rest or foot of splay nozzle holder. |
| 5 | Recessed groove on top of cross piece at aperture bottom. |
| 6 | Splay nozzle tongue. |
| 7 | Downturned rim on end of splay nozzle tongue. |
| 8 | Splay nozzle vertical baffle. |
| 9 | Splay nozzle platform. |
| 10 | Top edge of splay nozzle vertical baffle. |
| 11 | Apertures for screws. |
| 12 | Upper cross piece of splay nozzle holder, of lateral spout aperture. |
| 13 | Beveled or chamfered edges of aperture walls. |
| 14 | Side wall of lateral spout aperture. |
| 15 | Side wall of lateral spout aperture. |
| 16 | Angled leg of splay nozzle holder. |
| 17 | Angled leg of splay nozzle holder. |
| 18,18' | Clamp arms of splay nozzle holder. |
| 19 | Lateral spout. |
| 20 | Down spout segment. |
| 21 | Splay nozzle assembly. |

-continued

| LEGEND NO. | DESCRIPTION. |
|---|---|
| 22 | Hinge at junction of down spout and lateral spout. |
| 23 | Splay nozzle. |
| 24 | Screws. |
| A | Aperture in splay nozzle holder, for lateral spout. |
| W | Rain water effluent from splay nozzle. |

DETAILED DESCRIPTION OF THE INVENTION

The invention of down spout lateral outlet water splay apparatus discloses a water splay nozzle apparatus attached to the outlet end of lateral spout and the lateral spout inlet end attached by a hinge to a down spout outlet.

Figure 6:
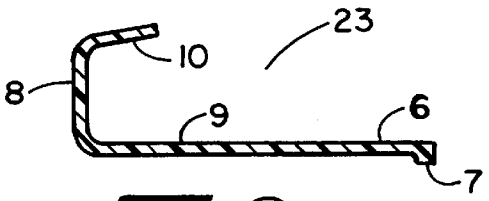
Figure 8:
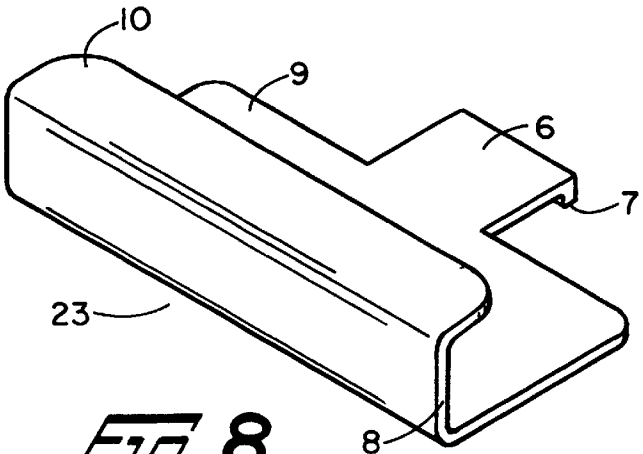
Figure 5:
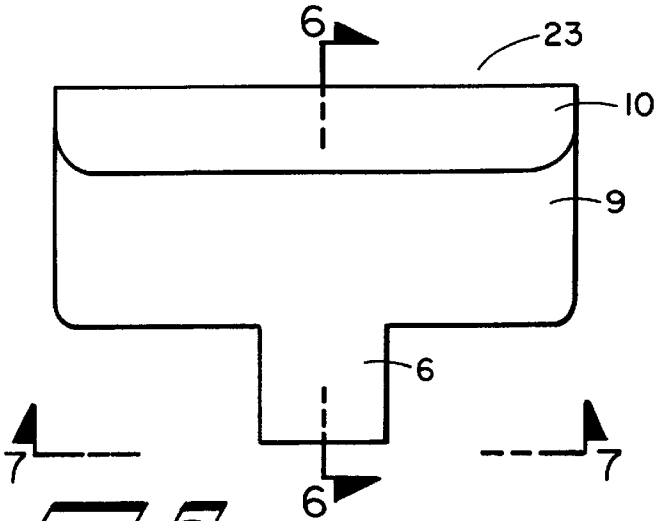
Figure 7:
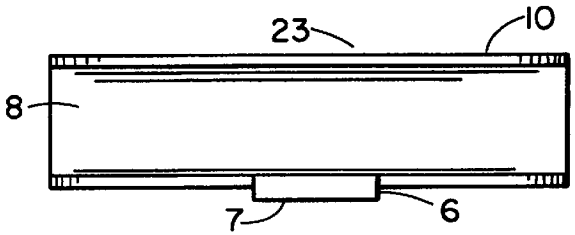
Figure 9:
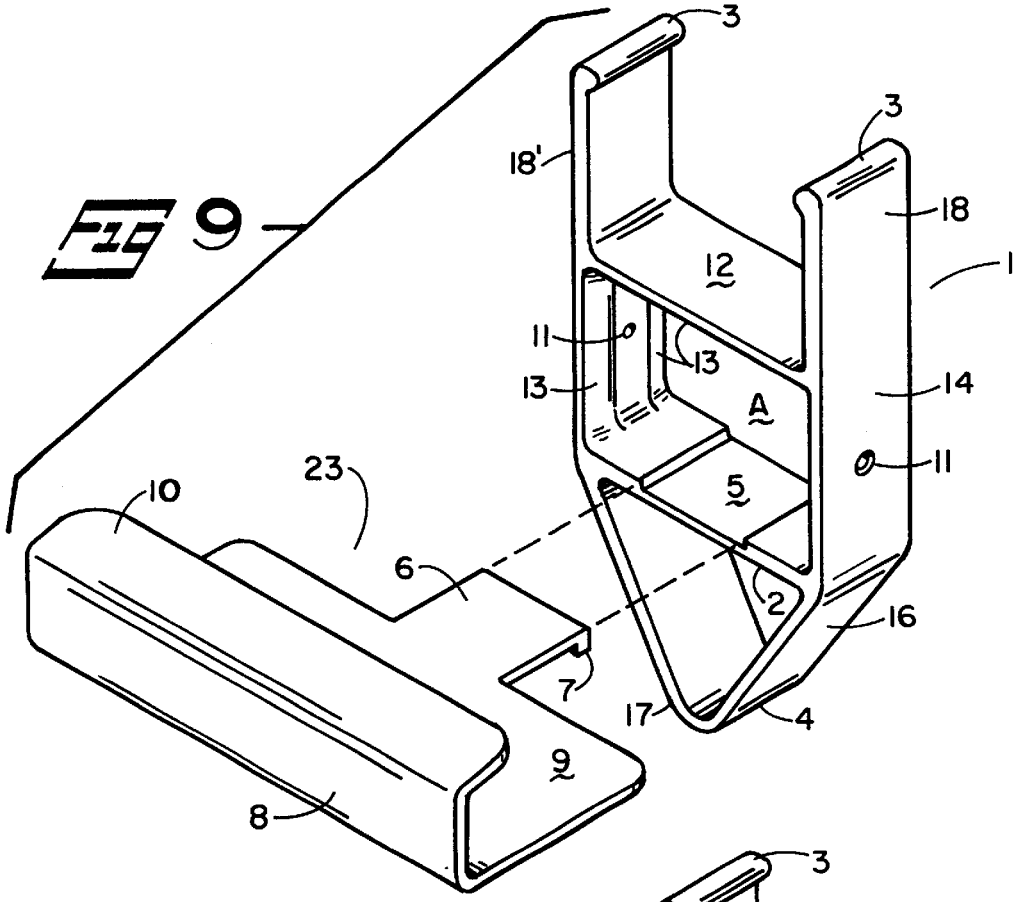

The water splay nozzle 23 is shown in FIGS. 5, 6, 7, 8, 9 and 14 and includes splay nozzle platform 9, a splay nozzle tongue 6, extending from the splay nozzle platform 9 and a splay nozzle vertical baffle 8, extending upwards from splay nozzle platform 9 opposite the splay nozzle tongue 6 extending from the platform 9, and a top edge 10 of splay nozzle vertical baffle 8 (see FIGS. 6 and 8). The splay nozzle vertical baffle 8 and the top edge 10 of the splay nozzle vertical baffle serve to turn the effluent water from the down spout lateral spout at an angle of 90° to splay the water on both sides of the splay nozzle 23, thus the water effluent from the lateral spout 19, is splayed out of the nozzle 23 perpendicular to the flow from the lateral spout 19. At the end of splay nozzle tongue 6 there is a downturned rim 7 on the edge of the tongue 6, see FIGS. 5, 6, 7, 8, 13 and 14, to extend downward beyond the top surface of lower cross piece 2, (see FIG. 14).

Referring now to FIG. 1, which is a front elevation view of water splay nozzle holder 1, showing lower cross piece 2, of splay nozzle holder of lateral spout aperture, and recess area 5, on top surface of lower cross piece 2, and ridges 3 on clamp arms 18, 18' of splay nozzle holder 1. Legend 4, is the ground rest, or foot of the splay nozzle holder 1.

Aperture A, in splay nozzle holder 1, is of such dimension to provide a friction fit around lateral spout 19 as shown in FIGS. 12, 13, 14, 15, 16, and 17, screws 24 may be used to hold lateral spout 19 in aperture A, by inserting screws 24 in apertures 11 for screws, see FIGS. 4, 9, 10, and 12.

Figure 2:
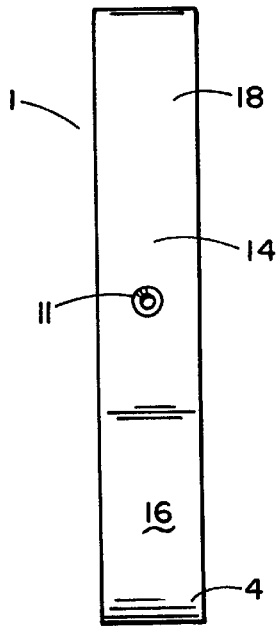

FIG. 2 is a side elevation view of water splay nozzle holder 1, showing aperture 11 for screw 24, and angled leg 16 of splay nozzle holder 1, joining ground rest or foot 4, of splay nozzle holder 1. Referring to FIG. 1, front elevation view of water splay nozzle holder 1, angled leg 16 of splay nozzle holder 1, and angled leg 17 of splay nozzle holder 1, join to form ground rest or foot 4, of splay nozzle holder 1.

The aperture A, for fitting around lateral spout 19 includes upper cross piece 12, side walls 14, 15 and lower cross piece 2 of splay nozzle holder 1,(see FIGS. 1, 3, 4, 9 and 10). Side walls 14, 15 and upper cross piece 12, are beveled or chamfered edges 13 (see FIGS. 1, 3, 4, 9, 10, 11) on the inside of the aperture A for entry of the lateral spout 19, into the splay nozzle holder 1. The lateral spout 19 entry is on the opposite side of the splay nozzle assembly 21 in aperture A, and the splay nozzle tongue 6 fits in recess groove 5 on top of lower cross piece 2 of splay nozzle holder 1.

Figure 3:
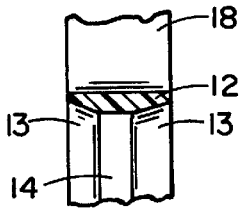
Figure 4:
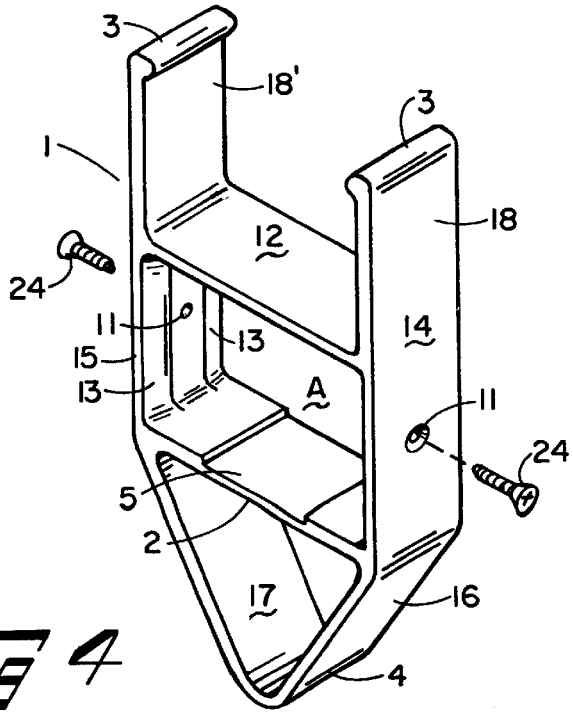
Figure 10:
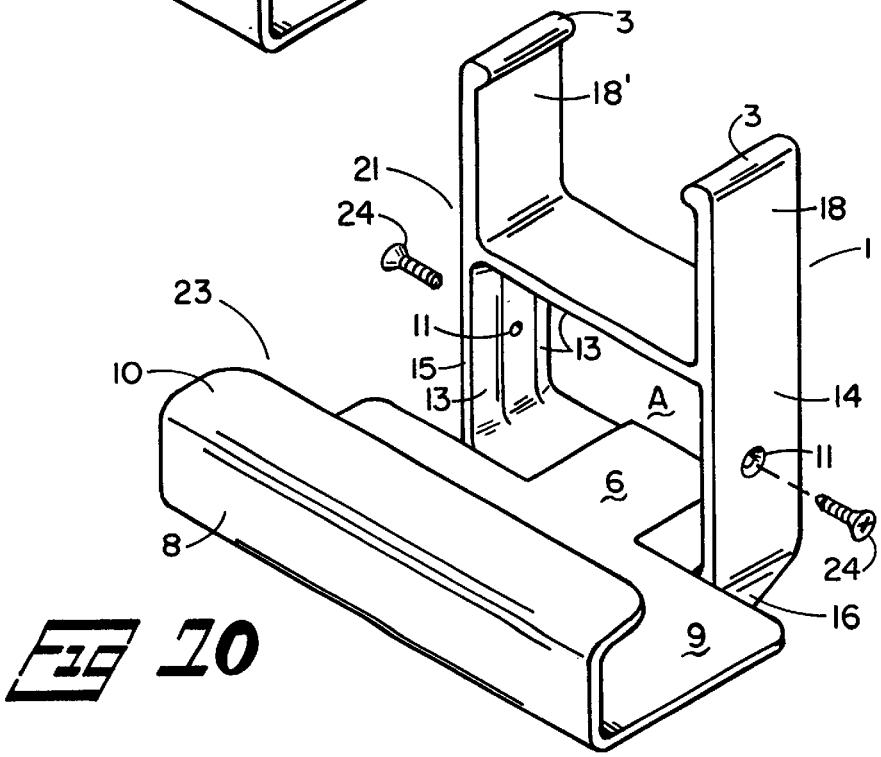
Figure 11:
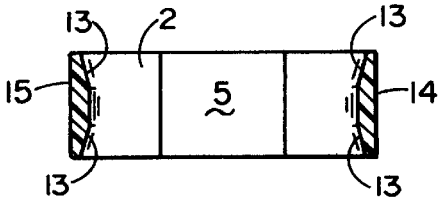

FIG. 11 is a cross section of side walls 14 and 15 of aperture A in splay nozzle holder 1, showing beveled or chamfered edges 13 on the side walls 14 and 15, and FIG. 3 shows the bevel or chamfer 13 on upper cross piece 12 of splay nozzle holder 1. The bevel or chamfer 13 noted on side walls 14 and 15, and on upper cross piece 12 are on the inside edges only of side walls 14 and 15 and upper cross piece 12 of the aperture A, and the edges are the points of entry of lateral spout 19 into aperture A, (see FIGS. 1, 3, 9, 10, and 11 to show the bevel or chamfer 13 in aperture A, in splay nozzle holder 1, on the opposite side of splay nozzle 23 mounted in the splay nozzle holder 1, and tongue 6, of splay nozzle 23, fitting in recess groove 6, on top of lower cross piece 2, of splay nozzle holder 1.

Figure 12:
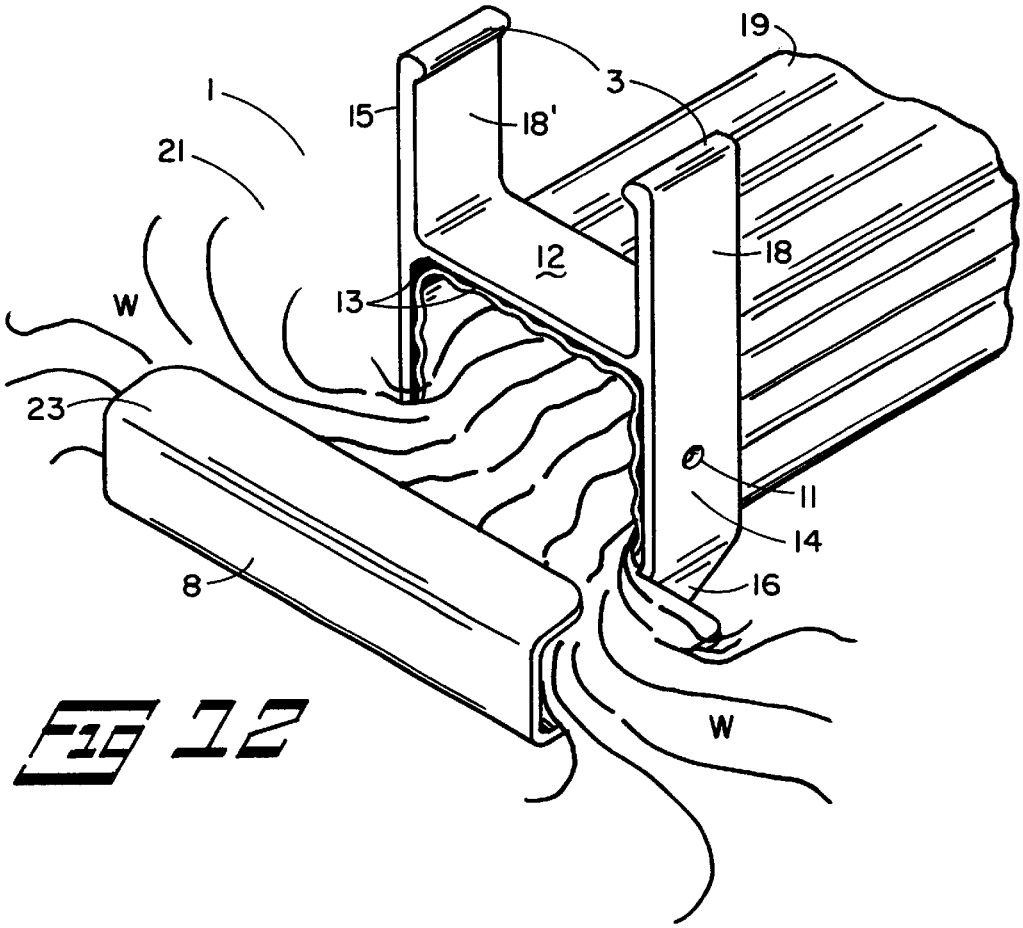
Figure 13:
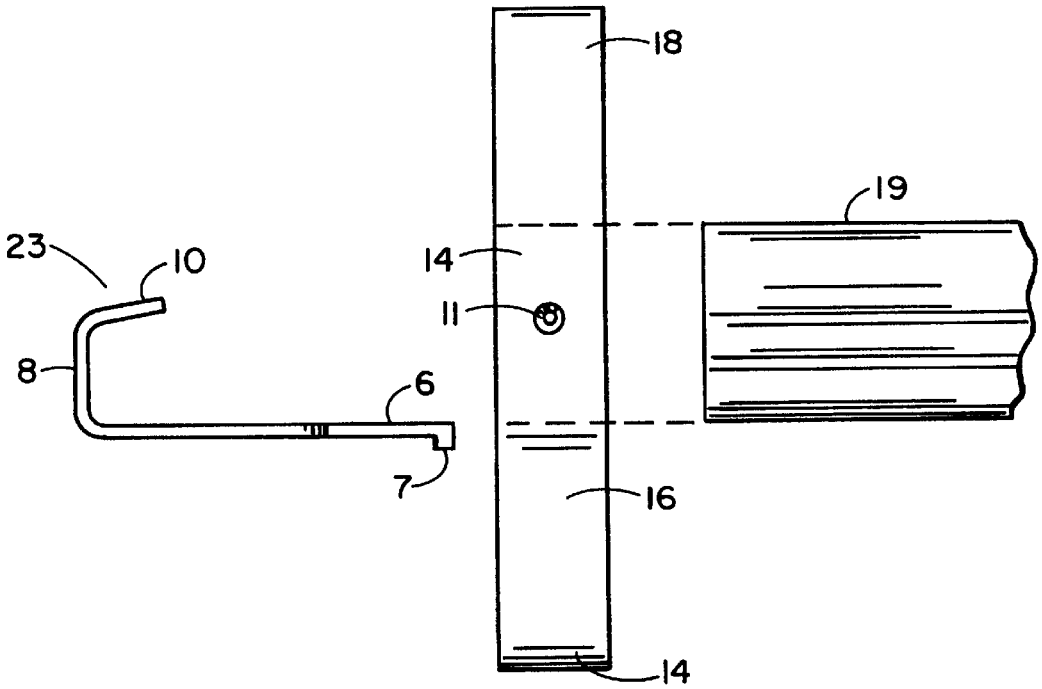
Figure 14:
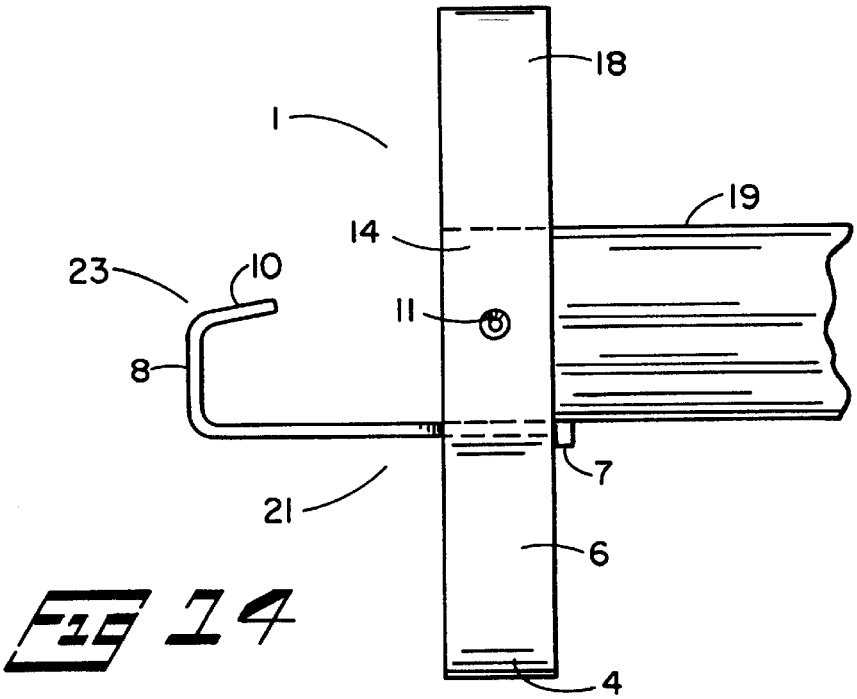

FIG. 10 is an assembly of splay nozzle 23, mounted on splay nozzle holder 1, and FIG. 12 is a complete assembly of down spout lateral outlet water splay nozzle apparatus, attached by friction fit of lateral spout 19 in aperture A of splay nozzle holder 1, and rain water W splayed outward or laterally by splay nozzle 23.

Figure 15:
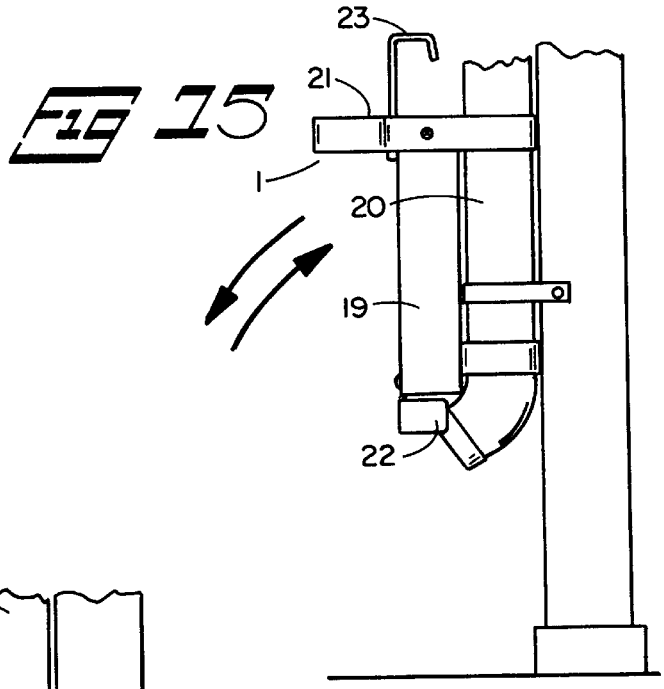
Figure 16:
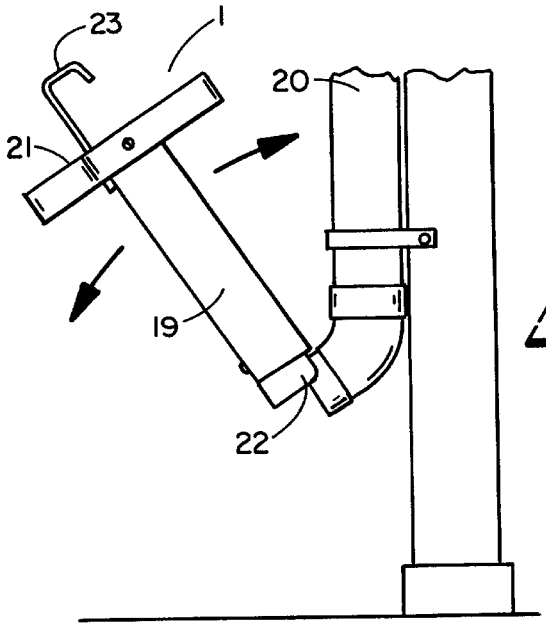
Figure 17:
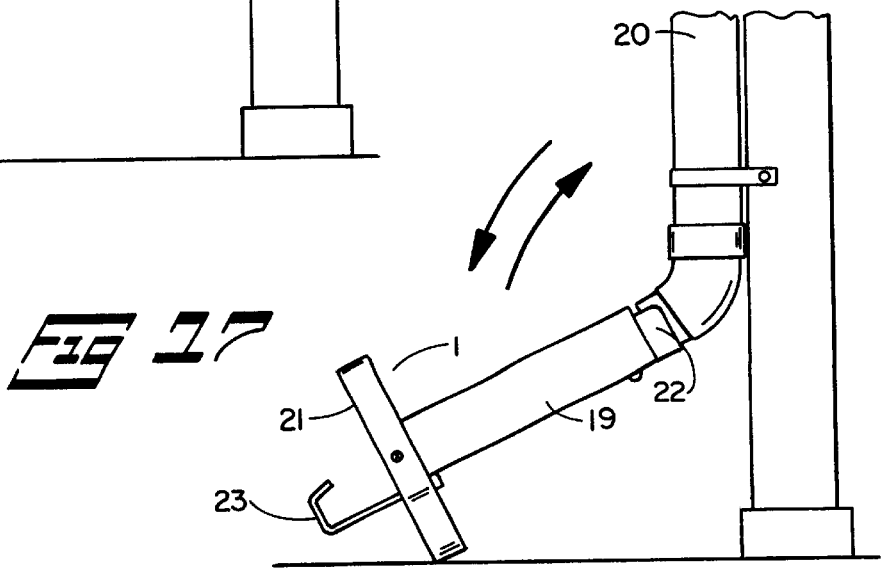

FIGS. 15, 16 and 17 shows the sequence of use of this invention including down spout segment 20, and a pivot hinge pin 22 at the junction of down spout segment 20 and lateral spout 19, and the splay nozzle assembly 21 mounted on the effluent end of lateral spout 19. FIG. 15 shows the lateral segment 19, with splay nozzle assembly 21 attached, and in an upturned position and clamp arms 18, 18' of splay nozzle holder 1, have a friction fit onto the down spout segment 20 and ridges 3 on clamp arms 18, 18' further help to hold the lateral spout in the upright position. The hinge 22 is standard and is well known. FIG. 16 shows the lateral spout 19 movable to either the "up" position, or "down" position. FIG. 17 shows the lateral spout in the "down" position, and the ground rest or foot 4, on the ground.

In view of the variance of dimension of cross section of lateral spout ducts, there are apertures 11 for screws 24 in side walls 14 and 15 of aperture A.

It is to be ppointed out that on splaying the water laterally by the splay nozzle 23, any debris carried by the water from the lateral spout 19, is also splayed laterally and thus is self cleaning and further splaying water by the splay nozzle 23 from the lateral spout 19 avoids erosion of the soil as is had on single point drainage of water from the lateral spout 19.

Having described our invention, we claim:

1. Downspout lateral outlet water splay nozzle apparatus comprising;

a—a splay nozzle b—a splay nozzle holder and an aperture in said splay nozzle holder, c—said aperture bounded by a lower cross piece, an upper cross piece, a side wall on each side of said aperture in said splay nozzle holder, d—clamp arms extending upward from each said side wall of said aperture in said splay nozzle holder and a ridge extending inward on the upper end of each of said clamp arms e—angled legs extending downward from the bottom end of each of said side walls of said aperture in said splay nozzle holder, f—said angled legs joined for a ground rest foot of said splay nozzle holder and, g—a splay nozzle comprising a splay nozzle platform, a splay nozzle tongue attached to said splay nozzle platform, h—a splay nozzle vertical baffle extending upward from said splay nozzle platform on the side opposite from said splay nozzle tongue, i—a top edge of said splay nozzle vertical baffle extending partly over said splay nozzle platform, j—a recess on top surface of said aperture bottom cross piece and, k—a down turned rim extending down ward on end of said splay nozzle tongue.

2. A method of splaying water laterally, from a downspout lateral outlet, water splay nozzle apparatus of claim 1 further comprising;

a—inserting lateral spout outlet into said aperture of said nozzle holder, b—said splay nozzle mounted on said nozzle holder, c—water from said lateral spout splaying laterally from said splay nozzle.

3. Downspout lateral outlet water splay nozzle apparatus of claim 1 further comprising;

a—inserting lateral spout outlet into said aperture of said splay nozzle holder and said splay nozzle tongue inserted into said aperture on recess on top of said cross piece at said aperture bottom, b—said tongue of said splay nozzle held in position by said lateral spout in said aperture, c—said lateral spout, hinged to a downspout, swings upward and clamp arms of splay nozzle holder friction fit onto downspout and d—said lateral spout, hinged to a downspout, swings downward to rest on the ground rest foot of said splay nozzle holder.

4. Downspout lateral outlet water splay nozzle apparatus of claim 1 further comprising;

a—apertures for screws in said sidewalls of said splay nozzle holder and, b—a down turned rim on end of said splay nozzle tongue.

* * * * *